US008459363B2

(12) United States Patent
Edwards

(10) Patent No.: US 8,459,363 B2
(45) Date of Patent: Jun. 11, 2013

(54) CONTROL MECHANISM FOR SUBSURFACE SAFETY VALVE

(75) Inventor: Jeffrey Edwards, Aberdeen (GB)

(73) Assignee: Enovate Systems Ltd., Aberdeen (GB)

( * ) Notice: Subject to any disclaimer, the term of this patent is extended or adjusted under 35 U.S.C. 154(b) by 586 days.

(21) Appl. No.: 12/595,901

(22) PCT Filed: Apr. 11, 2008

(86) PCT No.: PCT/GB2008/001281

§ 371 (c)(1),
(2), (4) Date: May 17, 2010

(87) PCT Pub. No.: WO2008/125824

PCT Pub. Date: Oct. 23, 2008

(65) Prior Publication Data

US 2010/0243267 A1 Sep. 30, 2010

(30) Foreign Application Priority Data

Apr. 14, 2007 (GB) ..... 0707219.2

(51) Int. Cl.
*E21B 34/14* (2006.01)
*E21B 34/16* (2006.01)

(52) U.S. Cl.
USPC ..... 166/373; 166/72; 166/386; 166/334.1; 166/334.2; 166/332.3

(58) Field of Classification Search
USPC ..... 166/373, 386, 334.1, 334.2, 72, 332.3
See application file for complete search history.

(56) References Cited

U.S. PATENT DOCUMENTS

| | | | | |
|---|---|---|---|---|
| 3,148,732 | A * | 9/1964 | Gage | 166/334.1 |
| 3,306,366 | A * | 2/1967 | Muse | 166/334.1 |
| 3,494,417 | A | 2/1970 | Fredd | |
| 3,724,501 | A | 4/1973 | Scott | |
| 3,791,445 | A | 2/1974 | True | |
| 3,815,675 | A | 6/1974 | Peters | |
| 3,830,306 | A | 8/1974 | Brown | |
| 4,508,173 | A | 4/1985 | Read | |
| 4,943,187 | A * | 7/1990 | Hopper | 405/190 |

FOREIGN PATENT DOCUMENTS

GB 2 369 845 A 6/2002

* cited by examiner

*Primary Examiner* — Giovanna Wright
(74) *Attorney, Agent, or Firm* — Tarolli, Sundheim, Covell & Tummino LLP

(57) ABSTRACT

A control mechanism for use with a safety valve adapted to seal a wellbore is described. The control mechanism comprises at least one valve actuator for engaging with the safety valve, the at least one actuator being moveable, in use, between a valve open position in which the safety valve is open and a valve closed position, in which the safety valve is closed. The control mechanism further comprises biasing apparatus adapted to bias the at least one valve actuator to the valve closed position, wherein, in use, the at least one valve actuator extends from the safety valve up to a wellbore wellhead. In one described embodiment, the safety valve is moved between the open and closed positions by movement of the at least one valve actuator with respect to the wellbore.

1 Claim, 5 Drawing Sheets

CONTROL MECHANISM FOR SUBSURFACE SAFETY VALVE

RELATED APPLICATION

This application corresponds to PCT/GB08/01281, filed Apr. 11, 2008, which claims the benefit of Patent Application No. GB 0707219.2, filed Apr. 14, 2007, which is herein incorporated by reference it its entirety.

FIELD OF THE INVENTION

The present invention relates to a control mechanism, particularly, but not exclusively, to a control mechanism for controlling a sub-surface safety valve.

BACKGROUND TO THE INVENTION

Subterranean wells are generally provided with one or more downhole safety valves. The primary function of the safety valve is to provide a reliable barrier between the well stream and the production control system in the event of the loss of pressure or structural integrity of the production system. Such a loss might include a catastrophic failure of the wellhead.

A conventional downhole safety valve is operated from the surface of the well through a platform supplied hydraulic control line strapped to an external surface of the production tubing. The valve control operates in a fail safe mode; that is hydraulic control pressure is used to hold open a ball or flapper assembly that will close if the control pressure is lost.

Downhole safety valves are routinely tested to ensure they will close in the event of a catastrophe. However, the valves sometimes close during normal production operations. One of the primary causes of valve closure is failure of the hydraulic control system. Safety valves are normally biased to the closed position by wellhead pressure, which can exceed 10000 psi. The pressure required to retain the valve in the open configuration is higher, normally equating to maximum wellhead pressure plus 1500 psi. Such a pressure requirement can be difficult to maintain, especially over the large distances encountered in an oil well. This problem is exacerbated in higher pressure wells.

When a downhole safety valve fails, production stops generally necessitating an unscheduled workover, which requires the use of a vessel. Not only is this an expensive operation but it also prevents health and safety risk, particularly in a deep water environment.

SUMMARY OF THE INVENTION

According to a first aspect of the present invention there is provided a control mechanism for use with a safety valve adapted to seal a well bore, the control mechanism comprising:

at least one valve actuator for engaging with the safety valve, the at least one actuator being movable, in use, between a valve open position, in which the safety valve is open, and a valve closed position, in which the safety valve is closed; and biasing apparatus adapted to bias the at least one valve actuator to the valve closed position;

wherein, in use, the at least one valve actuator extends from the safety valve up to a well bore well head.

A control mechanism according to at least one embodiment of the present invention is advantageous because the at least one valve actuator acts as a mechanical linkage between the safety valve and the well head. Therefore, it is not necessary to run a hydraulic line down to the safety valve, thereby overcoming the problems associated with hydraulic line failure.

Preferably, in use, the safety valve is moved between the open and closed positions by movement of the at least one valve actuator with respect to the well bore.

Preferably, the at least one valve actuator moves along an axis parallel to the well bore longitudinal axis.

Preferably, the at least one valve actuator is adapted to be located in a portion of the well bore isolated from well pressure.

Preferably, in use, a first end of the at least one valve actuator is adapted to engage a valve element. The valve element is the component which seals the well bore.

Preferably, in use, the first end of the at least one valve actuator engages the valve element by means of a rack and pinion.

Alternatively, in use, the first end of the at least one valve actuator engages the valve element by a geared arrangement or a camming mechanism or the like.

In one embodiment, the first end of the at least one valve actuator is exposed to well pressure. Exposure to well pressure assists in biasing the at least one valve actuator to the valve closed position.

In an alternative embodiment, the first end of the at least one valve actuator is isolated from well pressure. Isolating the valve actuator(s) from well pressure reduces the force required to be applied to the valve actuator(s) to overcome the biasing apparatus and open the valve.

Preferably, a second end of the at least one valve actuator is adapted to be engaged by an energising means.

Preferably, the energising means comprises a mechanical energiser.

Alternatively or additionally, the energising means may be the application of a load to the at least one valve actuator. The load may be applied by the installation of wellhead equipment on the wellhead, for example the installation of the christmas tree. Using the weight of the christmas tree to hold the valve in the valve open position means that in the event of the christmas tree separating from the wellhead, for example in the event of a catastrophic failure, the biasing apparatus will bias the valve to the valve closed position, thereby sealing the well.

Alternatively, or additionally, the energising means comprises a hydraulic energiser. As hydraulic pressure can be applied to the valve actuator at the wellhead, rather than in the confines of the well bore, the valve actuator can be arranged such that the pressure is applied to a larger surface area than would be possible down the well. As a the pressure can be applied to a large surface area a relatively low pressure can be used to overcome the well pressure, that is those systems which generate approximately 3000 psi, to energise the/each valve actuator. Low pressure systems are under less stress than high pressure systems and are generally more reliable. Furthermore, because the hydraulic actuator acts on the control mechanism at the wellhead, in the event of the hydraulic system failing, the hydraulic system can be easily replaced, without the need for a full workover, as the hydraulic actuator may be located externally of the well head.

In a further alternative the energising means comprises a differential piston.

Preferably, the control mechanism further comprises a quick release device for permitting ease of engagement and disengagement from the at least one valve actuator.

Preferably, a second end of the at least one valve actuator comprises a quick release mechanism first portion.

Preferably, a second portion of the quick release mechanism is adapted to be engaged by the energising means.

Preferably, the first and second portions define complementary engaging surfaces.

Preferably, the engaging surfaces can only engage in a single configuration. This arrangement ensures the distance between the valve actuator (and hence the safety valve) and the energising means can be determined and reproduced repeatedly.

Preferably, the second portion comprises latches for engaging the first portion.

Preferably, the latches are movably mounted to a second portion body.

Most preferably, the latches are pivotally mounted to the second portion body.

Preferably, the at least one valve actuator is a shaft.

Preferably, the biasing apparatus is a compression spring.

Alternatively, the biasing apparatus comprises a piston.

Preferably, the piston is biased by well pressure.

In one embodiment, the biasing apparatus comprises a combination of a compression spring and well pressure.

Preferably, there are two valve actuators.

Preferably, both valve actuators are adapted to engage a safety valve.

Preferably, the safety valve is a ball valve.

Alternatively, the safety valve is a flapper valve.

According to a second aspect of the present invention there is provided a method of actuating a downhole safety valve element, the method comprising the steps of:

energising a valve actuator, the valve actuator extending from a well head to a downhole safety valve; and translating the movement of the valve actuator into movement the safety valve element.

According to a third aspect of the present invention there is provided a production control system comprising:

a safety valve located in a pressurised portion of a well bore; and a control mechanism comprising:

at least one valve actuator for controlling the safety valve, the at least one actuator being movable, in use, between a valve open position, in which the safety valve is open, and a valve closed position, in which the safety valve is closed; and biasing apparatus adapted to bias the at least one valve actuator to the valve closed position;

wherein, the at least one valve actuator extends from the safety valve up to a well bore well head.

According to a fourth aspect of the present invention there is provided a control mechanism for a downhole tool, the control mechanism comprising:

at least one tool actuator, the at least one actuator being movable, in use, between a first position, in which the tool is in a first state, and a second position, in which the tool is in a second state; and biasing apparatus adapted to bias the at least one tool actuator to the one of the first or second positions;

wherein, in use, the at least one tool actuator extends from the downhole tool up to a well bore well head.

According to a fifth aspect of the present invention there is provided a control mechanism for a safety valve adapted to seal a pressurised portion of a well bore, the control mechanism comprising:

at least one valve actuator for controlling the safety valve, the at least one actuator being movable, in use, between a valve open position, in which the safety valve is open, and a valve closed position, in which the safety valve is closed; and biasing apparatus adapted to bias the at least one valve actuator to the valve closed position wherein the control mechanism is isolated from the pressurised portion of the well bore.

It will be understood that preferred and/or alternative features listed with respect to the first aspect of the invention may also be applicable to one or more of the subsequent aspects and are not repeated for brevity.

BRIEF DESCRIPTION OF THE DRAWINGS

An embodiment of the present invention will now be described with reference to the accompanying drawings in which.

DETAILED DESCRIPTION OF THE DRAWINGS

Figure 1:
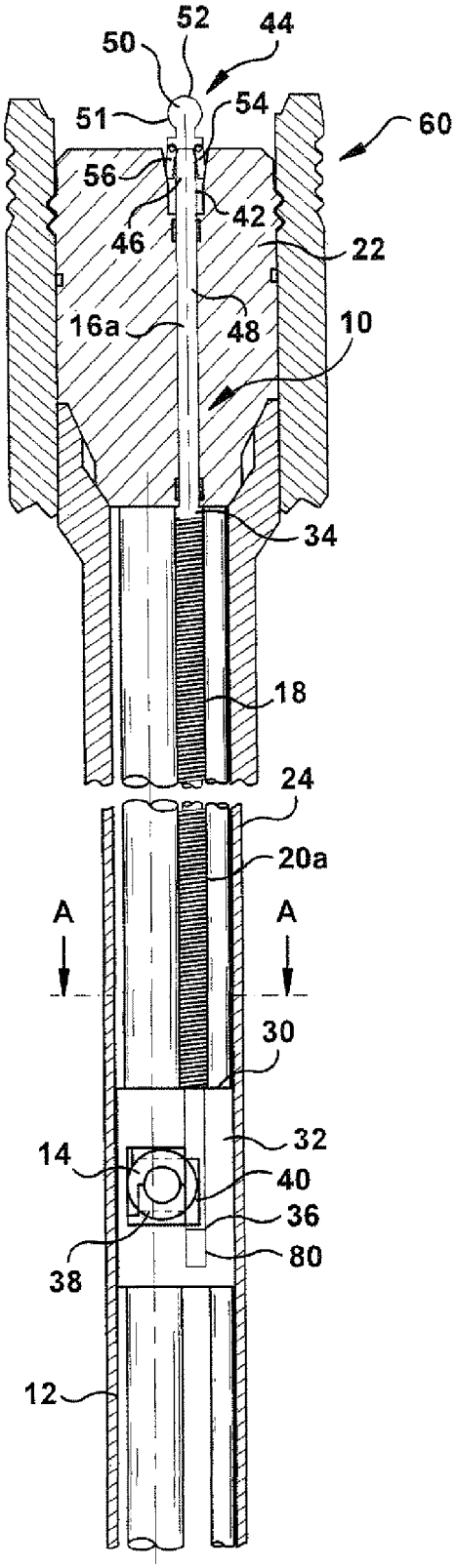
FIG. 1 is a cutaway side view of a control mechanism for a safety valve shown located in a well bore having a safety valve, with the safety valve shown in a closed configuration, according to an embodiment of the present invention.
Figure 2:
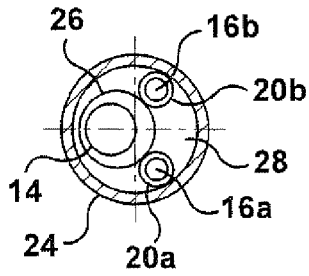
FIG. 2 is a section view through line A-A of FIG. 1.

Referring firstly to FIG. 1, there is shown a cutaway side view of a control mechanism, generally indicated by reference numeral 10, shown located in a well bore 12 having a safety valve 14, with the safety valve 14 shown in a closed configuration, according to an embodiment of the present invention, and FIG. 2, a section view through line A-A of FIG. 1.

The control mechanism 10 comprises two valve actuators 16*a*, 16*b* (best seen in FIG. 2), the actuators 16*a*, 16*b* being movable, in use, between a valve closed position, in which the safety valve 14 is closed, and a valve open position, in which the safety valve 14 is open (shown and discussed later in connection with FIG. 5). As can be seen the valve actuators extend from the wellhead 60 to the safety valve 14. The control mechanism 10 also comprises biasing apparatus 18 in the form of two compression springs 20*a*, 20*b*, one spring 20 associated with each of the valve actuators 16. The compression springs 20 are adapted to bias the valve actuators 16 to the valve closed position and act as a fail safe, automatically shutting the valve 14 in the event of an emergency. Each compression spring 20 is sandwiched between an upper surface 30 of a safety valve housing 32 and a circumferential actuator flange 34.

The valve actuators 16 run from a tubing hanger 22 situated in the wellhead 60 down through an annulus 28 (FIG. 2) formed between a production tube 26 and the well bore casing 24 to the safety valve 14. As can be seen most clearly from FIG. 2, the actuators 16 runs adjacent to but externally of the pressurised production tube 26.

Referring back to FIG. 1, each valve actuator 16 comprises a shaft 48 having a first end 36 and a second end 42. The first end 36 engages and rotates a safety valve ball element 38 by means of a rack and pinion arrangement 40. The first end 36 translates within a chamber 80 defined by the safety valve housing 32. As can be seen from FIG. 1, the ball element 38 has a throughbore shown in broken outline.

The second end 42 of each valve actuator 16*a*, 16*b* terminates in a quick release mechanism 44. Each quick release mechanism 44 comprises a first portion 46 defined by the valve actuator shaft 48, and a second portion 50 releasably attachable to the first portion 46. Each second portion 50 comprises a body 51 defining a ball 52 adapted to be attached to a socket of a mechanical energising system (not shown). Each second portion also comprises first and second latches 54, 56 pivotally mounted to the second portion body 51. The purpose of the latches 54, 56 will be discussed in due course.

Figure 3:
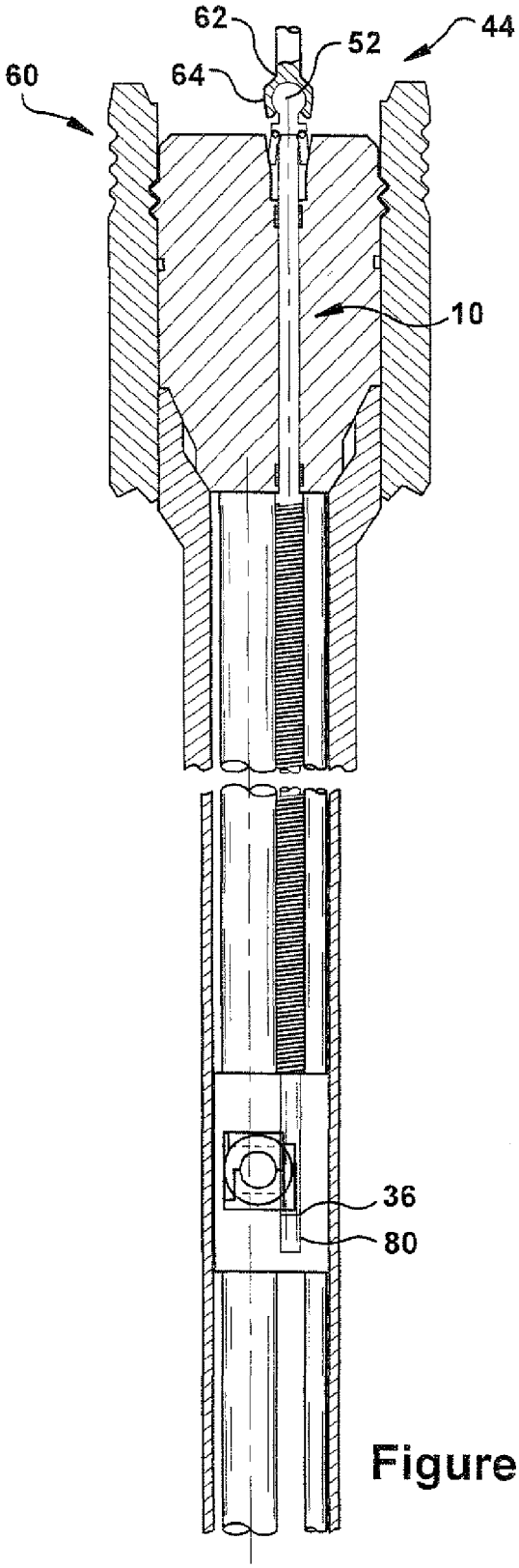
FIG. 3 is a cutaway side view of the control mechanism of FIG. 1 showing the control mechanism being engaged by a hydraulic energiser.

The operation of the control mechanism 10 will now be discussed with reference to FIGS. 3 to 6. Referring firstly to FIG. 3, a cutaway side view of the control mechanism 10 of FIG. 1 showing the control mechanism being engaged by a mechanically energised piston 62. The mechanically energised piston 62 is part of a christmas tree (not shown) installed on the wellhead 60.

Figure 4:
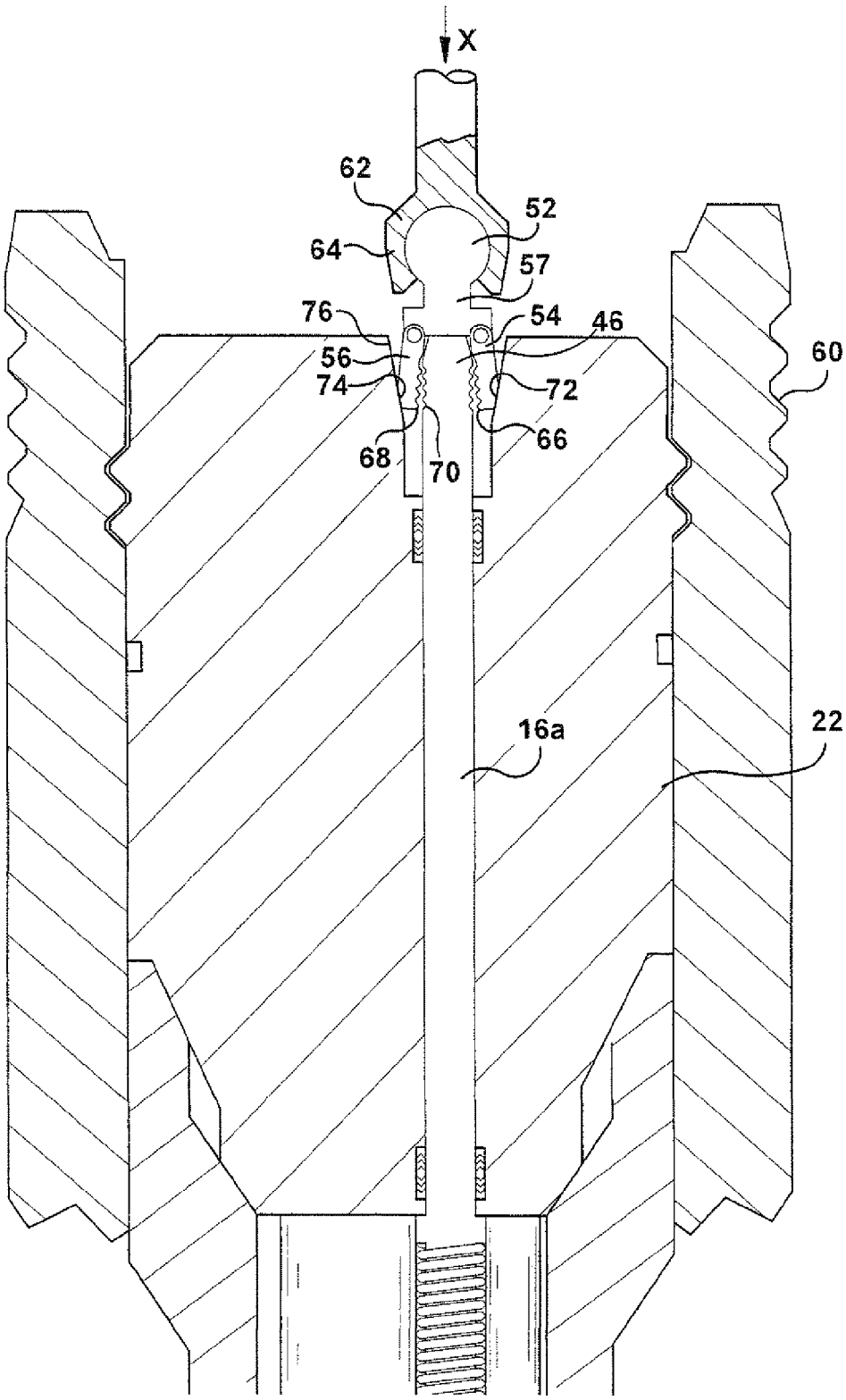
FIG. 4 is an enlarged, close up view of part of FIG. 3.

The mechanically energised piston 62 defines a socket 64 which engages and grips the second portion ball 52. This arrangement can be seen most clearly in FIG. 4, an enlarged, close up view of part of FIG. 3. FIG. 4 also clearly shows the arrangement of the quick release mechanism 44. The latches 54, 56 define profiled internal surfaces 66, 68 adapted to engage a complementary profile 70 defined by the quick release mechanism first portion 46. Each latch 54, 56 also defines an angled external surface 72, 74 which engages an angled surface 76 defined by a wellhead recess 82.

Referring to FIG. 4, the application of mechanical pressure to the piston 62 in the direction of arrow "X" will cause the valve actuators 16*a*, 16*b* to move in the direction of arrow "X" with respect to the wellhead 60. As the valve actuators 16 extend from the safety valve 14 to the wellhead plug 22, the mechanical energising system (not shown) can, therefore, be located externally of the wellhead 60 permitting the control system to be easily replaced, for example using an ROV, in the event of control system failure.

Furthermore, as the valve actuators 16 are located and move within a portion of the well casing 24 isolated from well pressure, only a relatively low pressure of around 3000 psi is required to overcome the biasing springs 20 and actuate the safety valve 14.

As the valve actuators 16 move, the engagement of the angled latch surfaces 72, 74 and the recess angled surface 76 causes the latches 54,56 to pivot towards the quick release mechanism first portion 46 such that the profiled surfaces 66, 68, 70 engage. The use of profiled surfaces 66, 68, 70 ensures reproducibility of the relative positions of the first and second quick release portions 46,50, which, in turn, ensures reproducibility of the relative positions of the hydraulic piston 62 and the safety valve 14.

Continued application of pressure to the valve actuators 16*a*, 16*b* moves the safety valve 14 to the open configuration against the action of the springs 20*a*, 20*b*. This position is shown in FIG. 5, a cutaway side view of the control mechanism 10 of FIG. 1 with the safety valve 14 shown in an open configuration.

Figure 5:
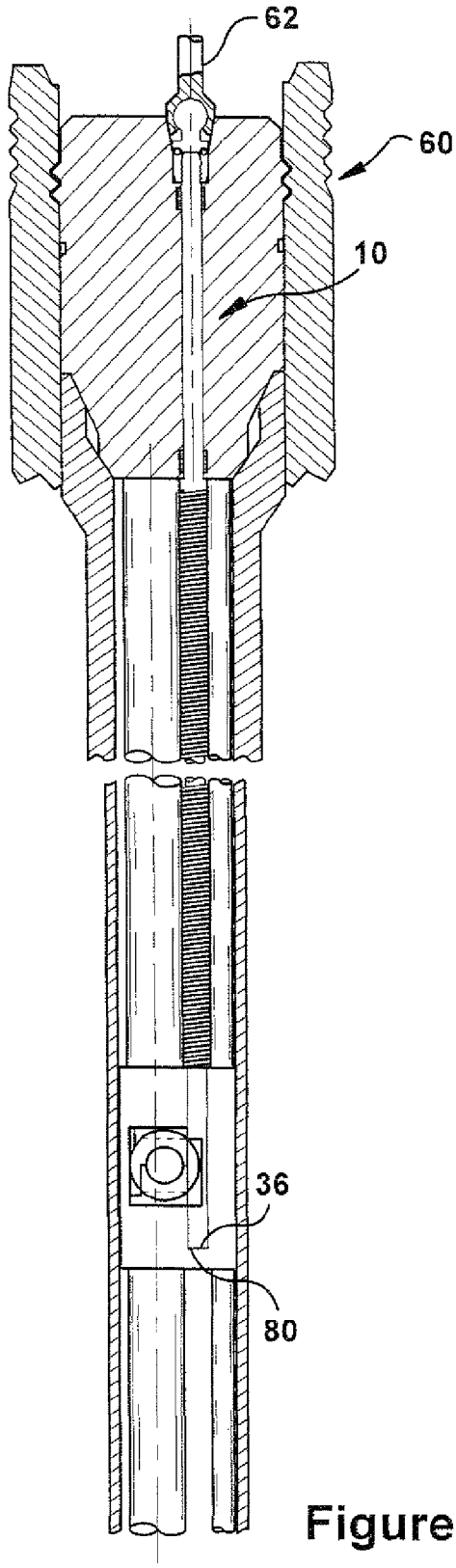
FIG. 5 is a cutaway side view of the control mechanism of FIG. 1 with the safety valve shown in an open configuration and FIG. 6 is an enlarged, close up view of part of FIG. 5.

As can be seen from FIG. 5, the first ends 36 of the valve actuators 16 have engaged the ends 82 of their respective valve housing chambers 80 indicating the ball element 38 has fully rotated to the closed position thus preventing over-rotation of the ball element 38.

Figure 6:
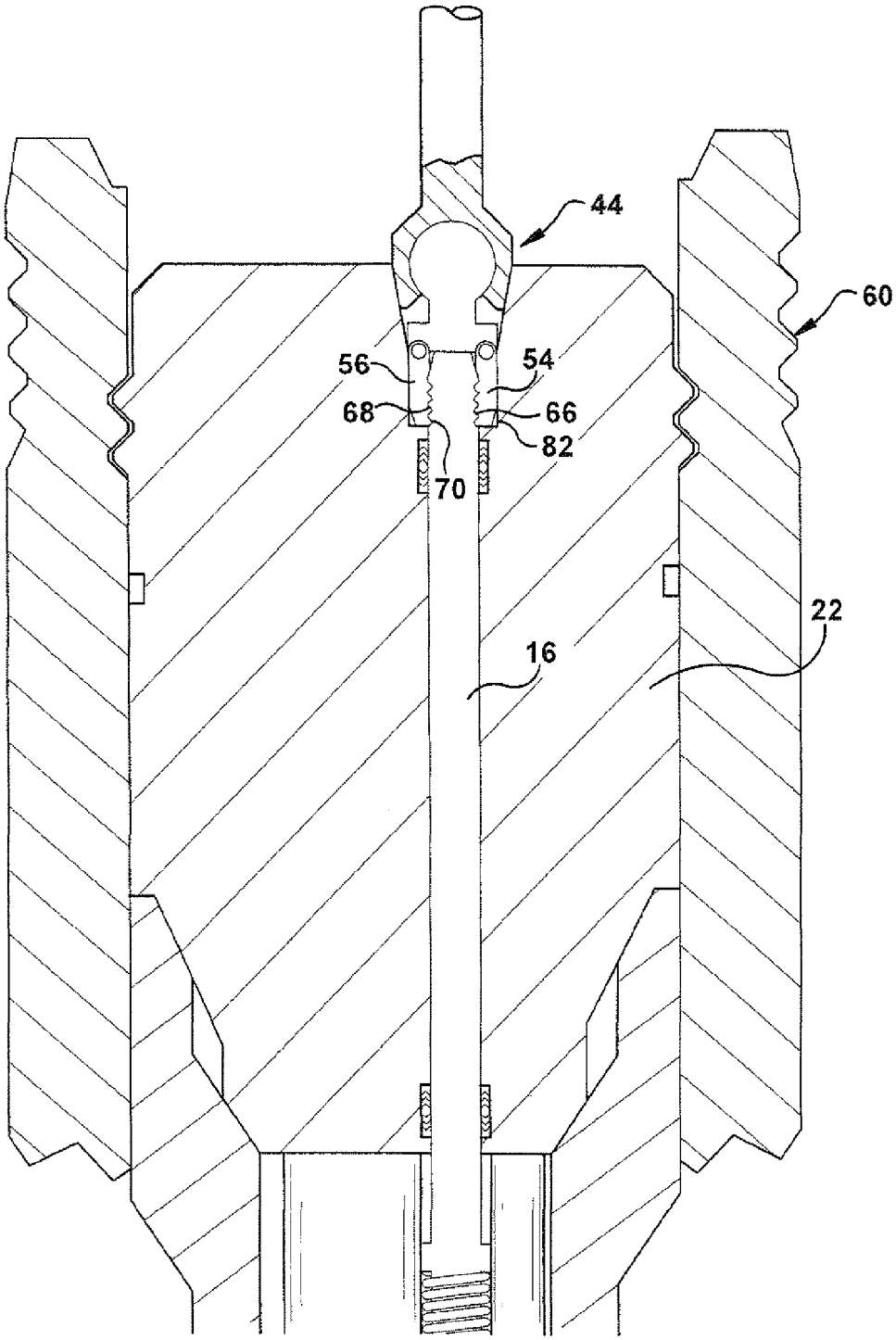

Referring to FIG. 6, it will be seen that the travel of the valve actuators 16 has forced the latches 54,56 into the well head recess 82 ensuring the latch profiled surfaces 72, 74 remain engaged with the profiled surface 70 defined by the first portion 46 of the quick release mechanism 44.

It will be understood, modifications and improvements may be made to the described embodiment without departing from the scope of the invention. For example, the safety valve could include a flapper element instead of a ball element. In another embodiment, the valve actuators could be biased towards the valve closed position by means of well pressure or a combination of a biasing spring or well pressure.

In the above described embodiment, the arrangement permits a christmas tree to be installed and tested under well pressure. As the mechanical energising piston operates independently of the christmas tree, the valve can therefore be shut in the event of a problem with the pressure test. Alternatively, the weight of the christmas tree alone could be used to move the valve actuators to the valve open position. In such a scenario removal of the christmas tree would be sufficient to close the valve.

In a further alternative the energising piston could be hydraulically controlled.

The invention claimed is:

1. A control mechanism for use with a safety valve adapted to seal a well bore, the control mechanism comprising:

at least one valve actuator for engaging with the safety valve, the at least one actuator being movable, in use, with respect to the well bore along an axis parallel to the well bore longitudinal axis, between a valve open position, in which the safety valve is open, and a valve closed position, in which the safety valve is closed; and biasing apparatus adapted to bias the at least one valve actuator to the valve closed position;

wherein, in use, the at least one valve actuator extends from the safety valve up to a well bore well head; wherein the control mechanism further comprises a quick release device for permitting ease of engagement and disengagement from the at least one valve actuator, a second end of the at least one valve actuator comprising a quick release mechanism first portion and a second portion of the quick release mechanism being adapted to be engaged by an energising means, and wherein the second portion comprises latches for engaging the first portion, the latches being movably mounted or pivotally mounted to a second portion body.

* * * * *

UNITED STATES PATENT AND TRADEMARK OFFICE

CERTIFICATE OF CORRECTION

PATENT NO. : 8,459,363 B2
APPLICATION NO. : 12/595901
DATED : June 11, 2013
INVENTOR(S) : Jeffrey Edwards It is certified that error appears in the above-identified patent and that said Letters Patent is hereby corrected as shown below:

On the title page of the Patent, in Assignee, item (73), should be changed to:

(73) Assignee: Enovate Systems Ltd., Abderdeen (GB)
--IRW Services Limited, Ellon (GB)--

Signed and Sealed this
Twenty-fourth Day of November, 2015

Michelle K. Lee

Michelle K. Lee
*Director of the United States Patent and Trademark Office*